US005866981A

United States Patent [19]

Saimi et al.

[11] Patent Number: 5,866,981

[45] Date of Patent: Feb. 2, 1999

[54] ELECTRODELESS DISCHARGE LAMP WITH RARE EARTH METAL HALIDES AND HALOGEN CYCLE PROMOTING SUBSTANCE

[75] Inventors: Motohiro Saimi; Atsunori Okada; Kazuhiko Watanabe; Shingo Higashisaka; Koji Nishioka, all of Kadoma, Japan

[73] Assignee: Matsushita Electric Works, Ltd., Osaka, Japan

[21] Appl. No.: 692,103

[22] Filed: Aug. 5, 1996

[30] Foreign Application Priority Data

Aug. 11, 1995 [JP] Japan ..... 7-205640

[51] Int. Cl.[6] ..... H01J 17/20

[52] U.S. Cl. ..... 313/570; 313/571; 313/636; 313/637

[58] Field of Search ..... 313/570, 571, 313/572, 636, 637, 638

[56] References Cited

U.S. PATENT DOCUMENTS 4,206,387 6/1980 Kramer et al. .
4,783,615 11/1988 Dakin .
5,363,015 11/1994 Dakin et al. ..... 313/638
5,479,072 12/1995 Dakin et al. .

FOREIGN PATENT DOCUMENTS 0 507 533 A2 10/1992 European Pat. Off. .
0 542 467 A1 5/1993 European Pat. Off. .
0 670 588 9/1995 European Pat. Off. .
2 030 762 4/1980 United Kingdom .

OTHER PUBLICATIONS

Patent Abstract of Japan, JP 61 138447A, vol. 10, No. 332 (E–453), Nov. 12, 1986 (TOSHIBA CORP), Jun. 25, 1986.

*Primary Examiner*—Vip Patel
*Attorney, Agent, or Firm*—Burns, Doane, Swecker & Mathis, L.L.P.

[57] ABSTRACT

An electrodeless metal vapor discharge lamp having an airtight arc tube formed with a light transmitting material of metal oxide and containing as sealed therein luminescent substances containing at least one or more of rare earth metallic halide, further includes a promoting substance which renders a halogen cycle occurring adjacent to inner wall surface of the arc tube to be more easily promoted, so as to prevent lamp starting voltage from raising up.

10 Claims, 7 Drawing Sheets

ELECTRODELESS DISCHARGE LAMP WITH RARE EARTH METAL HALIDES AND HALOGEN CYCLE PROMOTING SUBSTANCE

BACKGROUND OF THE INVENTION

This invention relates generally to electrodeless discharge lamps and, more particularly, to an electrodeless metal vapor discharge lamp in which an effective substance is filled in the arc tube.

DESCRIPTION OF RELATED ART

Generally, the electrodeless metal vapor discharge lamp employing a metallic halide as a luminescent substance reaches a high temperature within the arc tube during its lighting, so that the luminescent substance filled in the arc tube reacts with the arc tube, and there arise such problems that the arc tube changes its color, a devitrification or the like phenomenon of the arc tube takes place due to a crystallization of the material of the arc tube, the light transmittance of the tube is lowered, and the life of the arc tube is shortened.

Further, there is another problem that the starting voltage or lamp voltage is caused to be raised up by any halogen made to remain due to the metal of the metallic halide caused to melt in the arc tube, to react with the lamp tube or to disappear, so that the lamp will be no ignition or extinguishment, and the lamp life is shortened. In respect of the metal vapor discharge lamp having the electrodes, there has been suggested a method for prolonging the life of the lamp by means of the composition of filled substance in the discharge lamp.

In European Patent Application 670588, for example, there has been disclosed a measure for preventing a blackening due to an electrode present, by adding an excessive halogen, paying attention to a halogen cycle within the arc tube.

We have prepared an electrodeless discharge lamp containing in the arc tube an excess amount of halogen in gaseous state under such conditions as has been described in EP 670588 and its lighting is attempted, in order to prevent the reaction of the luminescent substance with the arc tube from occurring with the halogen cycle utilized. However, because of the presence in the arc tube of the excessive amount of halogen which is strong in the electron affinity, it has been found that electrons required for starting the lamp are taken away by halogen, the dielectric breakdown is rendered extremely difficult, and the luminous flux value upon the lighting is low. Further, while the charge of excess halogen in the state of metal halide may improve the difficulty in starting the lamp, it has been unable to prevent the deterioration in the luminous flux upon the lighting. That is, it has been found that the halogen cycle promotion for preventing the blackening of the arc tube due to the electrodes in the metal vapor discharge lamp having the electrodes is not suitable for the electrodeless metal vapor discharge lamp.

As an example of the electrodeless metal vapor discharge lamp in which the excessive halogen is filled, U.S. Pat. No. 4,783,615 describes one employing sodium iodide as the luminescent substance and mercury iodide as the excessive halogen. This discharge lamp causes sodium present adjacent to the inner wall surface of the arc tube to be changed to sodium iodide by means of the excessive halogen, so that D-line of sodium generated in central part of arc in the arc tube with sodium left itself will be self-absorbed, so as to prevent the efficiency to be lowered. In the event where mercury iodide is used as a substance for promoting halogen cycle in the electrodeless, metal vapor discharge lamp employing a rare earth metal halide as the luminescent substance, there are such problems that a high vapor pressure of mercury iodide renders the igniting difficult and, even if the lamp is ignited, the luminous flux amount upon being lighted is lower than that in the case where no mercury iodide is employed.

Further, an electrodeless metal vapor discharge lamp in which neodymium, a sort of rare earth metal, is employed as the luminescent substance has been described in U.S. Pat. No. 5,479,072. In the case where a rare earth compound is used as the luminescent substance and the arc tube is formed by a metal oxide, the rare earth metal is caused to react with the arc tube, and a complex oxide is formed. In the case of the electrodeless metal vapor discharge lamp, the above reaction is strong because arcs generated in the arc tube are closer to the inner wall surface of the arc tube as compared with the metal vapor discharge lamp having the electrodes. With the electrodeless metal vapor discharge lamp employing the rare earth metallic halide as the luminescent substance, there remains a problem that the complex oxide is produced due to the foregoing reaction and the igniting is caused to be difficult by remaining halogen as a result of the reaction, and it has been made difficult to improve this deteriorated startability unless some effective measure is taken.

SUMMARY OF THE INVENTION

The present invention has been suggested in order to eliminate the foregoing problems, and its object is to provide an electrodeless metal vapor discharge lamp which can improve the igniting characteristics and can restrain any devitrification of the arc tube as well as any raising up in the starting voltage caused by the reaction between the arc tube and the filled substance.

According to the present invention, the above object can be realized by means of an electrodeless metal vapor discharge lamp comprising an airtight arc tube formed with a light transmitting of a metal oxide, and a luminescent substance containing at least one or more of rare earth metallic halide and filled in the arc tube, characterized in that a promotor which renders a halogen cycle occurring adjacent to the inner wall surface of the arc tube to be more easily promoted.

Other objects and advantages of the present invention shall be made clear as the description of the invention advances in the followings with reference to preferred embodiments of the invention as shown in accompanying drawings.

Figure 5:
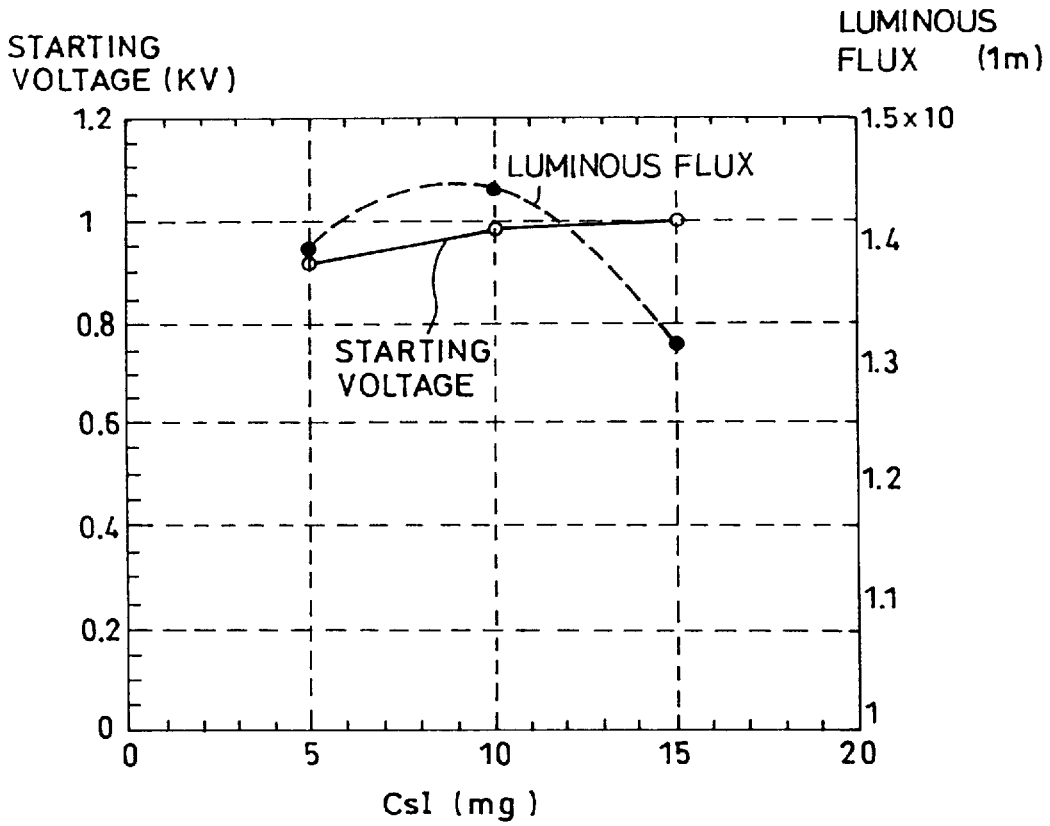
Figure 6:
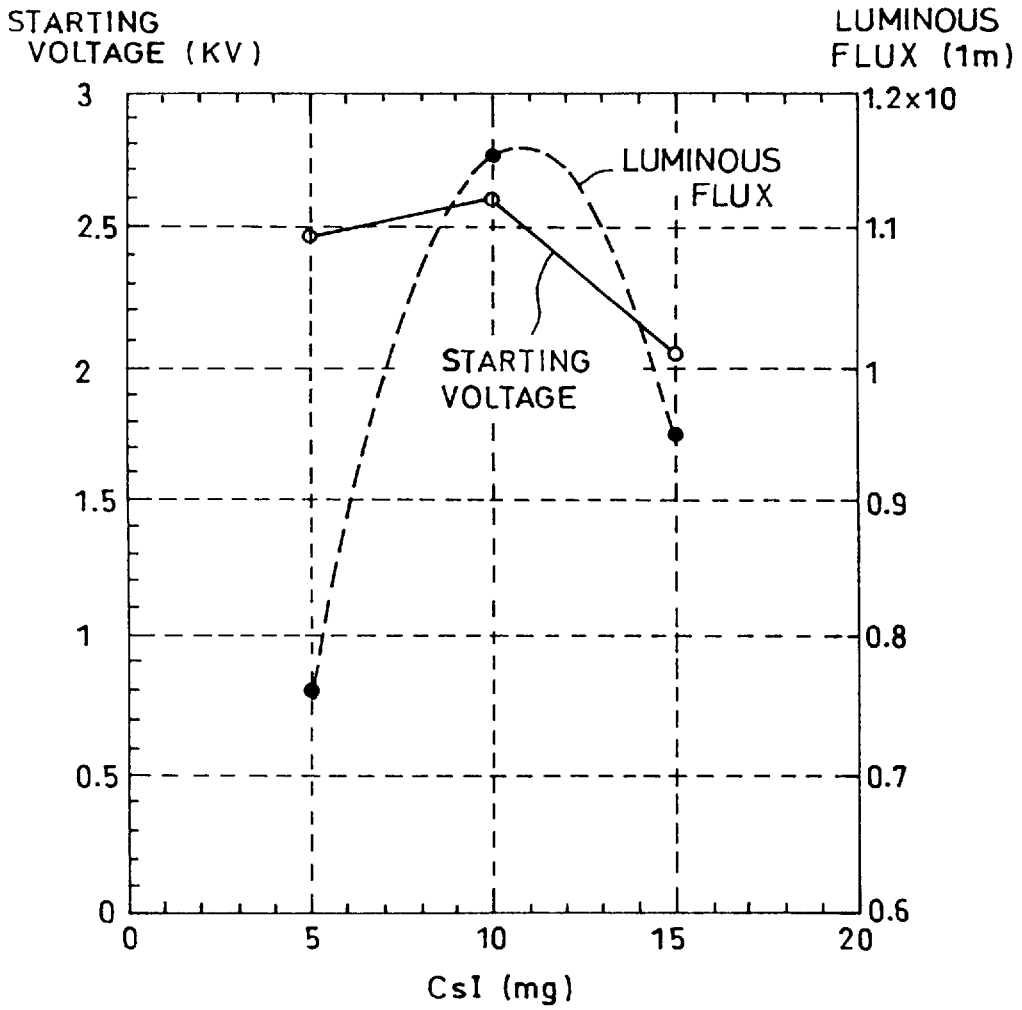
Figure 7:
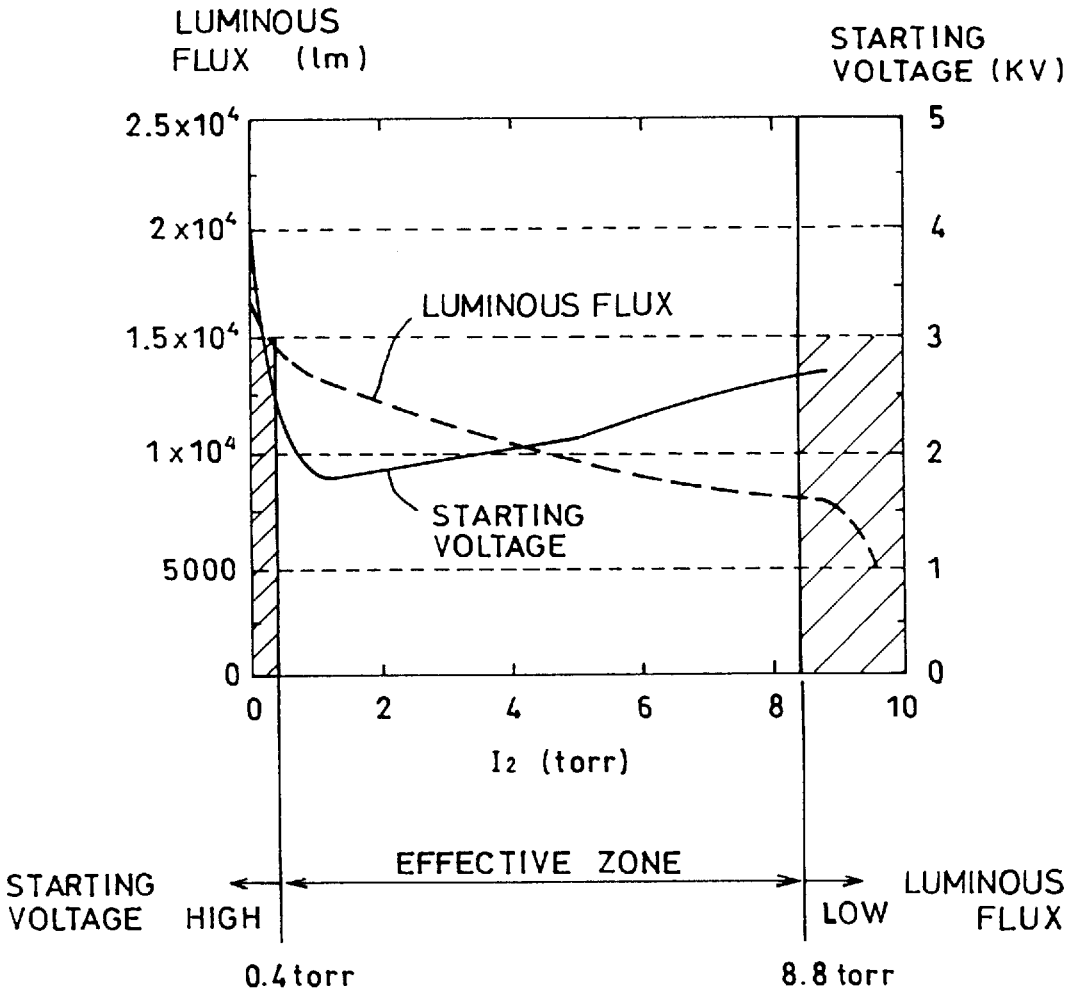
Figure 8:
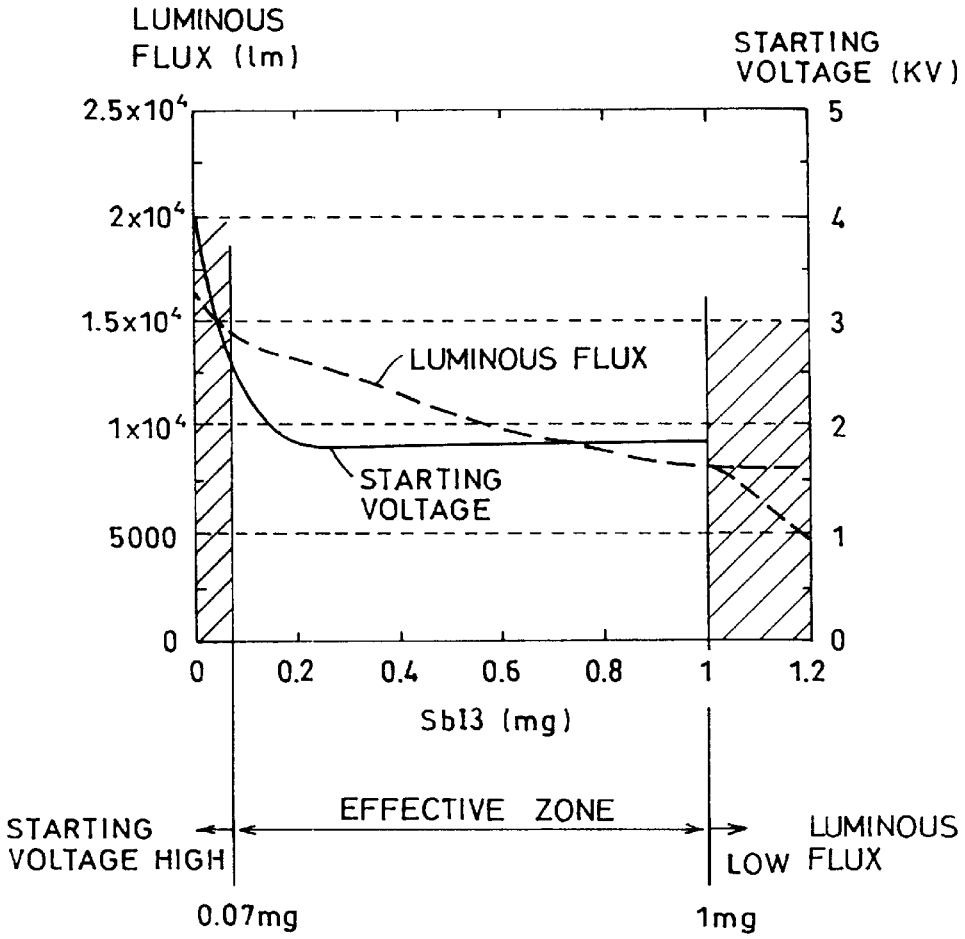

FIG. 5 is a diagram showing luminous flux and starting voltage after lighting for one hour while varying the amount of CsI in Embodiment 2 according to the present invention;

FIG. 6 is a diagram showing the luminous flux and starting voltage after lighting for 10,000 hours while varying the amount of CsI in Embodiment 2 according to the present invention;

FIG. 7 is a diagram showing the luminous flux and starting voltage after lighting for 10,000 hours while varying the amount of $I_2$ in Embodiment 3 according to the present invention; and FIG. 8 is a diagram showing the luminous flux and starting voltage after lighting for 10,000 hours while varying the amount of $SbI_3$ in Embodiment 1 according to the present invention.

While the present invention shall now be described in the followings with reference to the preferred embodiments, it should be appreciated that the intention is not to limit the present invention only to these embodiments but rather to include all alterations, modifications and equivalent arrangements possible within the scope of appended claims.

DETAILED DESCRIPTION OF THE PREFERRED EMBODIMENTS

The arrangement and operation of the electrodeless discharge lamp according to the present invention shall now be detailed in the followings.

Referring to quartz as an example of material for arc tube made of a metal oxide, there is caused to occur a devitrification when a rare earth metal is employed as the luminescent substance, due to a reaction of ions of the rare earth metal with quartz. Further, since rare earth metal is filled in the arc tube in the form of a metal halide, the reaction of rare earth metal with quartz causes rare earth metal to disappear but halogen to remain within the arc tube, and the strong electron affinity of halogen eventually results in a rise of the starting voltage or lamp voltage. While these phenomena should entail in a shortening of the life of discharge lamp, it has been also found that a use of such other metal oxide as alumina ceramics for the arc tube causes another reaction of rare earth metal with alumina ceramics.

The metal halide filled in the arc tube is causing the halogen cycle in which the metal halide dissociates into metal and halogen at a higher temperature part and the metal and halogen again bond to each other at a lower temperature part while the dissociated metal is excited to be luminous at the higher temperature part. By utilizing this halogen cycle, it is made possible to render the state of metal present adjacent to the inner wall surface of the tube in the electrodeless metal vapor discharge lamp from the state of metal ion high in the reactivity to a state in which the reactivity is lower, that is, to the state of metal halide. Depending on the amount of halogen, however, there may happens that the startability or the amount of luminous flux upon lighting of the electrodeless metal vapor discharge lamp is lowered. The present invention is featured in the use of a substance for promoting the halogen cycle, which substance can restrain the devitrification of the arc tube and the rise in the starting voltage caused to occur by the reaction of the arc tube with the filled substance during the lighting of the electrodeless metal vapor discharge lamp, without lowering the startability of the lamp nor the amount of luminous flux during the lighting of the lamp.

When a larger amount of halogen is present with respect to metal ions, the collision probability of the metal ions with halogen is high and the bonding into the metal halide becomes easier, so that the halogen cycle is promoted. Here, provided that halogen other than the metallic halide to be filled in the arc tube is further filled in the arc tube, or that a filled substance is optimumly selected so as to allow a large amount of halogen to be present in the arc tube during the lamp lighting, the metal ions are caused to become the metallic halide, whereby the density of the metal ions adjacent to the inner wall surface of the arc tube is minimized, the reaction between the luminescent substance and the arc tube is restrained, and the discharge lamp is prolonged in the life. The startability of the lamp is made better when the amount of gaseous halogen present in the arc tube while being not lit is made less.

Further, it should be appreciated that, as a measure for elevating the foregoing effect, a rare gas to be filled in the arc tube along with the luminescent substance is elevated in its pressure. When an attention is given to the metal ions or metal atoms on the inner wall surface of the arc tube, the higher the rare gas pressure, the higher the probability of collision of the rare gas with the metal ions or metal atoms. That is, while repeating the collision, the probability that the metal ions meet the electrons or halogen is increased, so as to become more stable metal atoms or metal halide with respect to the inner wall surface of the arc tube. The metal atoms may also become similarly metal halide.

The electrons, metal ions and so on which fly from plasma section within the arc tube towards the inner wall surface are also caused to increase the chance of collision, so that the kinetic energy of respective particles will be also decreased to have all damage given to the wall surface upon their collision with the wall surface effectively reduced. For the pressure of gas filled in the arc tube, its numerical limitation is difficult since the pressure is to vary depending on the type and so on of the lamp, but it is desirable that the pressure is set as high as possible within a range of allowance, taking into account the characteristics and so on of the particular lamp.

Figure 1:
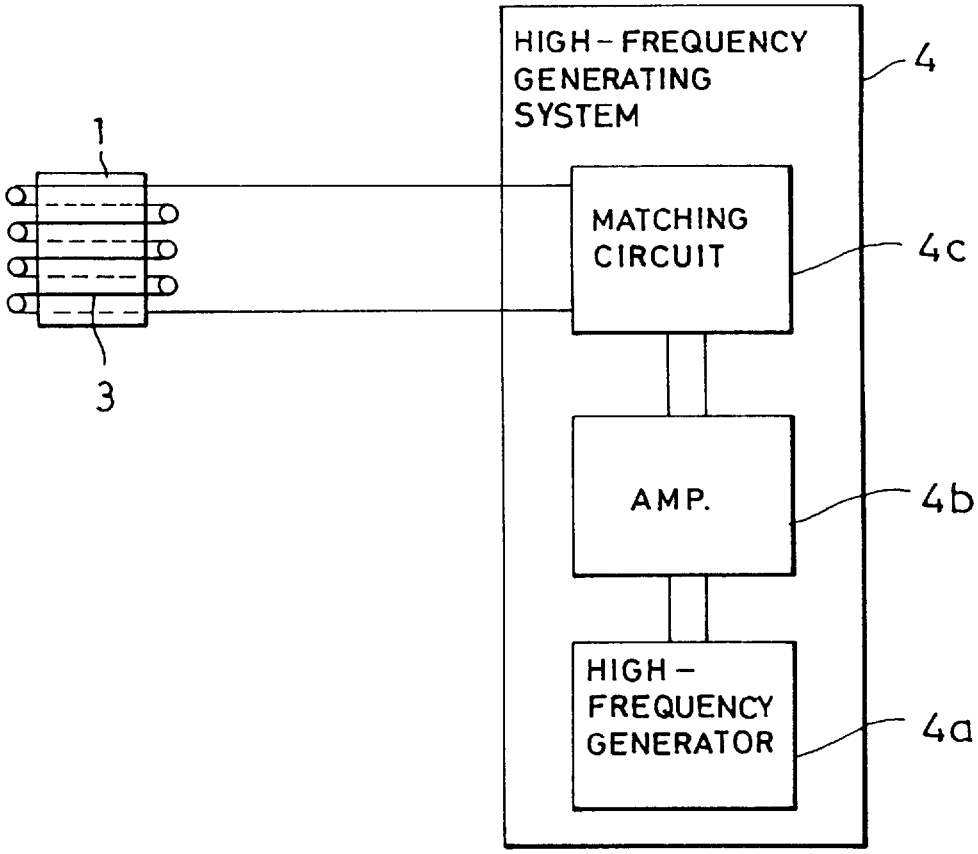
FIG. 1 is a schematic diagram showing the electrodeless metal vapor discharge lamp according to the present invention along with a lighting device therefor.

In FIG. 1, the electrodeless metal vapor discharge lamp according to the present invention is shown along with its lighting systems, in which the arc tube 1 forming the particular discharge lamp is formed airtightly with such material as a quartz glass having a light transmission properties. In the interior of the arc tube 1, the luminescent substance and rare gas are sealed. On the outer periphery of the arc tube 1, an induction coil 3 is wound, and is connected at both ends to a high frequency generating system 4, the latter of which comprises a high-frequency generator 4*a*, an amplifier 4*b* for amplifying an output from the high frequency generator 4*a*, and a matching circuit 4*c* interposed between the amplifier 4*b* and the induction coil 3 for matching their impedance.

EMBODIMENT 1

Figure 2:
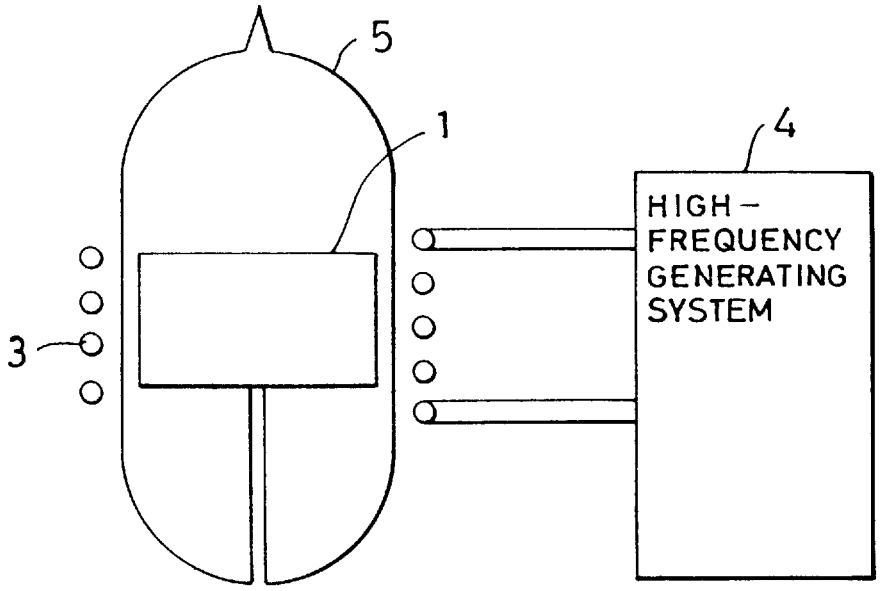
FIG. 2 is a schematic view showing the electrodeless metal vapor discharge lamp in Embodiments 1 to 3, 5 and 6 according to the present invention together with the lighting device.

FIG. 2 shows the electrodeless metal vapor discharge lamp and lighting systems in Embodiment 1, in which the electrodeless metal vapor discharge lamp comprises the arc tube 1, an outer envelope 5, and the induction coil 3. The arc tube 1 is cylindrical shape of 30 mm in the diameter and 15 mm high, a space between the arc tube 1 and the outer envelope 5 is drawn a vacuum, and it is intended to raise the coldest spot temperature of the arc tube 1. The arrangement shown here is one of working aspects according to the present invention, and it is of course unnecessary to limit the shape of the arc tube, substances to be filled therein and so on to those shown.

In respect of the present Embodiment 1, its experimental results are described in the followings.

The electrodeless metal vapor discharge lamp relating to Embodiment 1 is of such double tube structure as shown in FIG. 2, and the arc tube 1 is formed in a cylindrical shape of 30 mm diameter and 15 mm high. Within the arc tube 1, 15 mg of neodymium iodide ($NdI_3$) and 5 mg of cesium iodide (CsI) are filled as the luminescent substance. This cesium iodide produces, together with neodymium iodide, a complex halide for raising up the vapor pressure of neodymium iodide. (Generally, cesium iodide of a proper amount cooperates with the rare earth metallic halide to produce a complex halide, so as to be able to raise up the vapor pressure of the rare earth metallic halide.) Further, as a substance for promoting the halogen cycle, a halide of a high vapor pressure and multivalent is employed in order to raise up halogen vapor pressure within the arc tube during the lighting. In the present case, 0.2 mg of antimony iodide ($SbI_3$) is charged.

In an event of a lamp having no $SbI_3$ filled therein, the luminous flux was 16,600 lumen with an input power of 200 W upon initial lighting, and the initial stage starting voltage after the lighting for 1 hour was 1.6 kV, but the luminous flux maintenance factor after the lighting for 10,000 hours was 48%, and the starting voltage was 4.0 kV. Here, the starting voltage is a voltage of the induction coil 3, required for lighting the lamp. On the other hand, in the lamp of Embodiment 1, the luminous flux was 15,100 lumen with the input power of 200 W, initial starting voltage was 1.72 kV, the luminous flux maintenance factor after the lighting for 10,000 hours was 88%, and the starting voltage was 1.78 kV, and it has been found that improvements have been made in respect of the luminous flux maintenance factor and starting voltage.

Thus, with the filling of antimony iodide ($SbI_3$), its dissociation during the lighting of the lamp causes a large amount of iodine to be present in the arc tube, specifically with respect to Nd ions adjacent to the inner wall surface of the arc tube, so that the halogen cycle is promoted adjacent to the inner wall surface of the arc tube, and the reaction between the arc tube and the filled substances can be restrained. While the initial luminous flux has been reduced by 9%, this is due to that luminous volume of the discharge plasma was diminished by iodine. But it has been also found that the luminous flux maintenance factor can be remarkably improved and any deterioration of ignition due to the lighting can be also improved.

During the lighting, antimony iodide is useful in promoting the halogen cycle with much iodine produced through the dissociation whereas, during the non-lighting, the substance is present in the arc tube in the state of antimony iodide due to low temperature in the arc tube but not in the state of gas, and the ignition property is not impaired. Results of further detailed investigation of a lamp employed in Embodiment 1 (result of the lighting for 10,000 hours) are as shown in FIG. 8. In this lamp of Embodiment 1, the amount of antimony iodide filled as the halogen cycle promotor in the arc tube suitable for practical use was from 0.07 mg to 1 mg, taking into account the starting voltage and luminous flux value during the lighting.

While in the present Embodiment 1 there have been employed neodymium iodide as the luminescent substance and antimony iodide of high vapor pressure and multivalent halide as the halogen cycle promoting substance, further investigation of other rare earth metallic halides and other metallic halides as the halogen cycle promoting substance has revealed such results as shown in the followings.

Required conditions for the halogen cycle promoting substance are that, in order to maintain the igniting properties taking into account the life, the substance is the metallic halide of a vapor pressure above 1 Torr and below 1,000 Torr at 400° C., and its amount to be filled in the arc tube is, when the composition of its metallic halide is represented to be MXn (M: metal, X: halogen, n: the number of halogen), more than $5\times10^{-3}/(n/2)$ mol with respect to 1 mol of rare earth metal contained in the foregoing luminescent substance. Further when the amount of luminous flux during the lighting is taken into account, the amount to be filled in the arc tube should be preferably more than $5\times10^{-3}/(n/2)$ mol and less than $5\times10^{-1}/(n/2)$ mol.

EMBODIMENT 2

Test results in respect of the present Embodiment 2 shall be first described. A lighting test has been performed in respect of lamps with neodymium iodide ($NdI_3$) made to be of a fixed amount but with cesium iodide (CsI) varied in the amount. The arc tube employed were of a cylindrical shape of a diameter of 30 mm and a height of 15 mm, and three different lamps were prepared with the filled neodymium iodide at a fixed amount made to be 15 mg while varying the filled amount of cesium iodide to be 5 mg, 10 mg and, 15 mg.

As a result of lighting for 1 hour, the first lamp of $NdI_3$: 15 mg and CsI: 5 mg has shown the luminous flux of 13,900 lumen and the starting voltage of 0.92 kV; the second lamp of $NdI_3$: 15 mg, CsI: 10 mg has shown the initial luminous flux of 14,400 lumen and the starting voltage of 0.98 kV; and the third lamp of $NdI_3$: 15 mg, CsI: 15 mg has shown the initial luminous flux of 13,100 lumen and the starting voltage of 1.00 kV.

Further, after the lighting for 10,000 hours, the first lamp of $NdI_3$: 15 mg, CsI: 5 mg has shown the luminous flux of 7,600 lumen and the starting voltage of 2.45 kV; the second lamp of $NdI_3$: 15 mg, CsI: 10 mg has shown the luminous flux of 11,500 lumen and the starting voltage of 2.6 kV; and the third lamp of $NdI_3$: 15 mg, CsI: 15 mg has shown the luminous flux of 9,500 lumen and the starting voltage of 2.05 kV.

The above results taken on a diagram will be as shown in FIGS. 5 and 6, in which FIG. 5 is the diagram showing the luminous flux and starting voltage after the lighting for 1 hour, and FIG. 6 is the diagram showing the luminous flux and starting voltage after the lighting for 10,000 hours.

As will be clear from these diagrams, it has been found that the luminous flux shows the largest value when the amount of CsI is about 10 mg. This is caused by that, while CsI has an effect of increasing the volume of plasma within the arc tube, the luminescence of its own is in the region of infrared and, if the filled amount is large, the luminous flux is thereby decreased. With respect to the starting voltage, the larger the amount of CsI, the smaller the rising of the starting voltage. This is caused by that the larger amount of CsI increases the amount of iodine with respect to Nd in the arc tube to promote the halogen cycle, while Cs is small in the reactivity to the arc tube.

When such deterioration in the luminous flux and igniting property is taken into account, a proper amount of CsI is considered to be in a range of 8 to 20 mg. In respect of other rare earth metallic halide, too, substantially the same results have been obtained. It has been found that this CsI amount should preferably be made in a range of 1.00 to 2.70 mol, as converted with respect to 1 mol of the rare earth metal.

EMBODIMENT 3

In this Embodiment 3, 100 Torr of xenon (Xe) gas, such rare earth metallic halides as 15 mg of neodymium iodide ($NdI_3$) and 5 mg of cesium iodide (CsI) as the luminescent substances, and further 0.5 Torr of iodine gas (corresponding to $5.7\times10^{-3}$ with respect to $NdI_3$: 1 mol) are filled in the arc tube.

Next, results of lighting tests employing the lamp of this Embodiment 3 and a further lamp of Comparative Example in which no iodine gas is filled shall be described. In the case of the lamp of Comparative Example, the luminous flux during the initial lighting (lighting for 1 hour ) was 16,600 lumen under an input power of 200 W and the initial stage starting voltage was 1.6 kV, while the luminous flux maintenance factor after the lighting for 10,000 hours was 48% and the starting voltage was 4.0 kV.

In respect of the lamp of the present Embodiment 3, on the other hand, the luminous flux in the initial lighting (for 1 hour ) was 15,400 lumen under the input power of 200 W, and the initial stage starting voltage was 1.68 kV, while the luminous flux maintenance factor and the starting voltage after the lighting for 10,000 hours were 88% and 1.75 kV, respectively. Thus, it has been found that there have been improvements both in the luminous flux maintenance factor and starting voltage.

By charging the iodine gas in the arc tube as in the above, it has been enabled to allow a much amount of iodine to be present adjacent the inner wall surface of the arc tube 1 during the lighting, to promote thereby the halogen cycle adjacent to the wall of the arc tube, and to restrain the reaction of the filled substances with the arc tube. While the initial luminous flux was decreased by 7%, this should be due to that the luminescent volume of the discharge plasma was reduced by the presence of iodine. But it has been possible to remarkably improve the luminous flux maintenance factor and startability.

With the filled amount of iodine increased, the halogen cycle is more easily promoted to render the deterioration to be less, but there arises a problem that the luminous flux value is made smaller. In view of the test results, it has been found that the reaction between the arc tube and the filled substances can be restrained when the filled amount of iodine is set to be 1 to 2 Torr, and the decrease in the initial stage luminous flux can be also restricted to be several %. Results of further detailed investigation of the lamp employed in Embodiment 3 (after the lighting for 10,000 hours) are as shown in FIG. 7. In the case of the lamp employed in Embodiment 3, the amount of iodine gas filled in the lamp as the halogen cycle promoting substance, taking into account the starting voltage, was more than 0.4 Torr. Further, the amount of iodine gas filled as the halogen cycle promoting substance in the lamp suitable for practical use taking into account the starting voltage and luminous flux value during the lighting has been 0.4 to 8.8 Torr. As a result of investigation of other rare earth metallic halides, it has been found that, taking also into account the life and luminous flux, the filling of halogen gas by more than $5.0\times10^{-3}$ mol and less than $1.0\times10^{-1}$ mol with respect to 1 mol of the rare earth metal suffices the purpose.

EMBODIMENT 4

Figure 3:
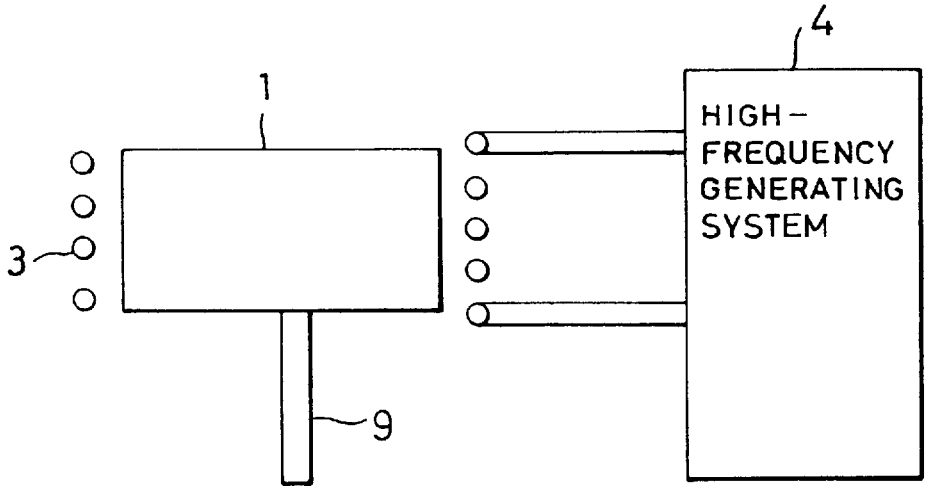
FIG. 3 is a schematic view showing the electrodeless metal vapor discharge lamp in Embodiment 4 according to the present invention together with the lighting device.
Figure 4A:
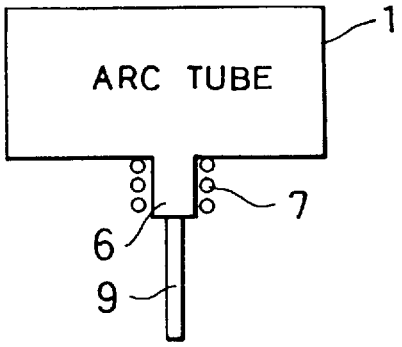
FIGS. 4A, 4B and 4C are schematic explanatory views for manufacturing steps of the arc tube of Embodiment 4 according to the present invention, respectively with a state in which halogen is generated, a state in which halogen has been generated, and a state in which an auxiliary pipe has been mounted as sealed.

FIGS. 3 and 4 show Embodiment 4, in which a part 1 that forms the arc tube is in a cylindrical shape of a diameter of 30 mm and the height of 15 mm, and a cylindrical auxiliary tube 6 of a diameter of 5 mm and a length of 10 mm as well as a support rod 9 are provided substantially to the center of bottom face of the arc tube part 1, while the arc tube part 1 and auxiliary tube 6 are made to communicate with each other through a junction as seen in FIG. 4A and are forming therein an identical airtight space.

Within the thus constituted airtight space, such rare earth metallic halides as neodymium iodide ($NdI_3$) of 15 mg and cesium iodide (CsI) of 5 mg were filled as the luminescent substance, to be present in the auxiliary tube 6. Further, 100 Torr of xenon (Xe) gas was charged in the space, as a starting gas.

Figure 4B:
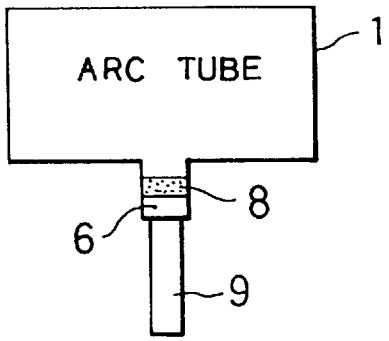

Next, as shown in FIG. 4A, the lamp was lighted for 1 hour with an input power of 300 W supplied to a coil 7 wound on the outer periphery of the auxiliary tube 6, and, there was observed a devitrification of white turbidity (denoted by a reference 8 in the drawing) on the inner wall of the auxiliary tube 6 at the portion where the coil is wound, as shown in FIG. 4B. It has been confirmed through later analysis that a free iodine is being generated simultaneously with the devitrification. For the amount of generation of such free iodine, it should be readily appreciated that the free iodine is generated by an amount enough for starting the lamp.

Figure 4C:
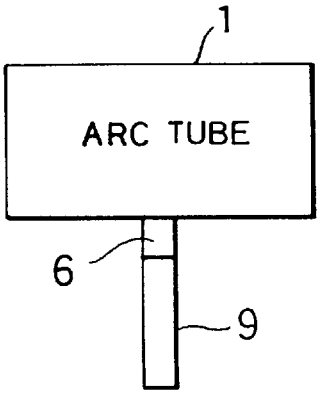

As shown in FIG. 4C, next, the junction part of the auxiliary tube 6 and the arc tube 1 is closed by means of a burner, so as to limit the airtight space only to the arc tube part 1 of the diameter of 30 mm and the height of 15 mm. It should be appreciated that, upon closing the junction part, neodymium iodide, cesium iodide and iodine generated upon the previous lighting are to be sealed in the arc tube 1.

Results of the lighting tests with the thus manufactured lamp of Embodiment 4 and the lamp prepared as Comparative Example without charging therein any iodine gas are as in the followings. In the case of the lamp of Comparative Example, the luminous flux was 13,600 lumen upon the initial lighting for 1 hour with the input power of 200 W, and the initial starting voltage (the required inter-coil voltage of t he induction coil 3 for lighting the lamp) was 1.5 kV, while the luminous flux maintenance factor after the lighting for 10,000 hours was 57% and the starting voltage was 4.0 kV. On the other hand, the lamp of Embodiment 4 has shown 12,700 lumen with the input power of 200 W, the initial starting voltage of 1.6 kV, the luminous flux maintenance factro of 88% after the lighting for 10,000 hours, and the starting voltage of 1.9 kV, and it has been found that the luminous flux maintenance factor and starting voltage have been both improved. As a result of investigation of the generated amount of iodine gas, equivalent effect to that in Embodiment 3 could be obtained also in the present Embodiment 4, by controlling the area 8 where the devitrification has occurred as shown in FIG. 4B (by varying the dimensions of the auxiliary tube 6 and/or winding number of the coil 7 on the outer periphery of the auxiliary tube 6). In the case of Embodiment 4, it is possible to have the iodine gas generated after the manufacture of the lamp, without providing in the lamp manufacturing facilities any path for leading the iodine gas, and iodine can be easily treated with the particular facilities.

Further, while the lamp of Embodiment 4 has shown the same results as those in the lighting with such system as shown in FIG. 3 (without the outer envelope), it would be needless to say that the lamp of Embodiment 4 is also applicable to the double tube system having the outer covering tube as shown in FIG. 2, similarly to other embodiments.

EMBODIMENT 5

In the present Embodiment 5, the arrangement of the lighting means is the same as that in the foregoing embodiments. The difference from other embodiments resides in that a spherical arc tube made of quartz and of a diameter of 27 mm is used as the arc tube 1. Embodiment 5 is an aspect of the present invention, and the configuration of the arc tube or filled substances and the like should not be limited thereto. Other than Xe gas of 200 Torr, in the arc tube 1, there are filled such rare earth metallic halides as 15 mg of $NdI_3$ and 5 mg of CsI as the luminescent substances. Further, as the halogen cycle promoting substance, 0.2 mg of antimony iodide ($SbI_3$) is charged. In the present embodiment, further, among halides of sodium and lithium which are red-color emission substances, 2 mg of sodium iodide (NaI) was added in order to lower the color temperature. When this lamp was subjected to the same initail lighting (lighting for 1 hour) as in the foregoing embodiments (with input power of 180 W), then its results were, as the lamp characteristics before the addition of sodium iodide, the luminous flux: 13,700 lumen, color temperature: 6,500K, general color rendering index: 82, whereas the lamp characteristics after the addition of sodium iodide were the luminous flux: 14,600 lumen, color temperature: 5,800K, and general color rendering index: 80, and it has been possible to lower the color temperature. On the other hand, the initial stage starting voltage upon the initial lighting (lighting for 1 hour ) was 1.7 kV but, at the time of the lighting for 500 hours, the starting voltage was elevated to 4.3 kV. This is considered to be that, with 0.2 mg of antimony iodide ($SbI_3$) filled as the halogen cycle promoting substance for restraining the reaction of the rare earth metallic halides with the arc tube, a reaction of sodium as the red-color emission substance with the arc tube could not be restrained but sodium has rather melt into the arc tube, and eventually produced free iodine has caused the starting voltage to be raised up. In order to restrain the reaction of sodium with the arc tube, therefore, an increase of the halogen cycle promoting substance which was the red-color emission substance was tried. Thus, a lamp was prepared by further adding 0.4 mg of antimony iodide ($SbI_3$) as the halogen cycle promoting substance to the same filled substances as in the above (Xe gas: 200 Torr, NdI: 15 mg, CsI: 5 mg, NaI: 2 mg), and the same test has been executed. The lamp characteristics upon the initial lighting (lighting for 1 hour ) were the luminous flux: 13,500 lumen, color temperature: 5,700K, and general color rendering index: 80. The initial stage starting voltage was 1.72 kV, which has not varied to remain 1.72 kV even at the time of 500 hours of the lighting and, as a result of continued lighting test, such excellent results as the starting voltage of 1.81 kV and luminous flux maintenance factor of 87% were obtained even after the lighting for 10,000 hours.

Then, the description shall be made with reference to a case where 0.3 mg of indium iodide (InI) was employed in place of 0.4 mg of antimony iodide additionally filled as the halogen cycle promoting substance acting also as the red-color emission substance. The characteristics of this lamp upon the initial lighting (lighting for 1 hour ) were the luminous flux: 15,500 lumen, color temperature: 5,500K, and general color rendering index: 86. Further, the initial stage starting voltage was 1.76 kV, and, as the result of the lighting for 10,000 hours, 1.83 kV of the starting voltage and 87% of the luminous flux maintenance factor were obtained. As compared with the case of 0.4 mg antimony iodide, substantially the same excellent result was obtained in respect of the starting voltage, and also improvements have been attained in respect of the luminous flux and the general color rendering index.

In an event where halides of lithium were used as other rare earth metallic halide or the red-color emission substance, substantially the same results could be obtained. Collecting these results, the same effect as in other embodiments in respect of the starting voltage without being remarkably raised up even after the lighting more than 10,000 hours can be attained by further adding the halogen cycle promoting substance for use as the red-color emission substance, in addition to the foregoing amount as will be later defined in claim 2 with respect to the rare earth metal. At this time, it is necessary to take into account that the luminous flux amount will be lowered when the halogen-cycle promoting substance is filled too much for use as the red-color emission substance. Conditions for adding the halogen-cycle promoting substance for use as the red-color emission substance will be that a metallic halide of a vapor pressure at 400° C. being more than 1 Torr and less than 1,000 Torr is additionally charged in a charging amount of more than $1\times10^{-3}/(n/2)$ mol with respect to 1 mol of sodium, lithium or their total contained in the red-color emission substance, in an event when the composition of the metallic halide is represented by MXn (M: metal, X: halogen, n: number of halogen), in order to prevent the starting voltage from being raised up. When the luminous flux amount during the lighting is taken into account, further, it has been found that the total of the halogen-cycle promoting substance for use as the rare earth metal and the additional halogen-cycle promoting substance as the red-color emission substance should preferably be less than $1\times10^{-1}/(n/2)$ mol.

EMBODIMENT 6

References to this Embodiment 6 shall be also started from its test results. The arc tube 1 was of the cylindrical shape of a diameter of 30 mm and a height of 15 mm, in which 11 mg of neodymium bromide ($NdBr_3$), 15 mg of neodymium iodide ($NdI_3$) and 5 mg of cesium iodide (CsI) were filled in the arc tube 1 as the luminescent substance. This lamp was lighted by means of such lighting device as shown in FIG. 2 with the input power of 200 W, and its luminous flux and starting voltage were compared for investigation with a lamp as a comparative example ($NdI_3$: 30 mg, CsI: 5 mg). Here, $NdBr_3$: 11 mg and $NdI_3$: 15 mg are substantially the same in mol figure, and the two arc tubes prepared for the test are made to be the same in the mol figure of Nd.

In the case of the lamp according to Embodiment 6, the luminous flux was 14,800 lumen and the starting voltage was 1.01 kV after the lighting for 1 hour. After further continued lighting for 10,000 hours, the luminous flux was 10,900 lumen and the starting voltage was 1.71 kV. In the case of the other lamp prepared as the comparative example, the luminous flux was 13,000 lumen and the starting voltage was 1.01 kV after the 1 hour lighting but, after the 10,000 hours lighting, the luminous flux was 7,800 lumen and the starting voltage was 2.46 kV.

From the above results, it is seen that the lamp of the present Embodiment 6 shows smaller degree of deterioration in the luminous flux and starting voltage. This is because the lamp of Embodiment 6 contains iodide and bromide filled in the lamp as the halides which are respectively independently vaporized during the lighting, so that iodide and bromine are present mutually independently, the total number of halogen eventually present in the arc tube will be larger in ($NdI_3$+$NdBr_3$+CsI) than ($NdI_3$+CsI), and the halogen cycle can be promoted.

What is claimed is:

1. An electrodeless metal vapor discharge lamp, comprising an airtight arc tube formed with a light transmitting material of a metal oxide, a luminescent substance filled in said arc tube and containing at least one or more rare earth metallic halide, and a promoting substance filled in the arc tube for rendering a halogen cycle occurring adjacent to inner wall surface of the arc tube to be easily promoted, wherein said promoting substance is a metallic halide of which vapor pressure at 400° C. is above 1 Torr and less than 1,000 Torr, and in an amount of more than $5\times10^{-3}/(n/2)$ mol with respect to 1 mol of a rare earth metal contained in said luminescent substance, when the composition of said metallic halide is represented as MXn (M: a metal, X: halide and n: the number of halogen).

2. The discharge lamp according to claim 1 wherein said metallic halide promoting substance is in an amount of more than $5\times10^{-3}/(n/2)$ mol and less than $1\times10^{-1}/(n/2)$ mol with respect to 1 mol of a rare earth metal contained in said luminescent substance.

3. An electrodeless metal vapor discharge lamp, comprising an airtight arc tube formed with a light transmitting material of a metal oxide, a luminescent substance filled in said arc tube and containing at least one or more rare earth metallic halide, and a promoting substance filled in the arc tube for rendering a halogen cycle occurring adjacent to inner wall surface of the arc tube to be easily promoted, wherein said promoting substance is a metallic halide such as antimony iodide ($SbI_3$).

4. An electrodeless metal vapor discharge lamp, comprising an airtight arc tube formed with a light transmitting material of a metal oxide, a luminescent substance filled in said arc tube and containing at least one or more rare earth metallic halide, and a promoting substance filled in the arc tube for rendering a halogen cycle occurring adjacent to inner wall surface of the arc tube to be easily promoted, wherein said promoting substance is cesium halide in an amount of 1.00 to 2.70 mol with respect to 1 mol of rare earth metal contained in said luminescent substance.

5. An electrodeless metal vapor discharge lamp, comprising an airtight arc tube formed with a light transmitting material of a metal oxide, a luminescent substance filled in said arc tube and containing at least one or more rare earth metallic halide, and a promoting substance filled in the arc tube for rendering a halogen cycle occurring adjacent to inner wall surface of the arc tube to be easily promoted, wherein said promoting substance is one selected from the group consisting of simple substances of halogen gas of iodine, bromine and chlorine and their mixture gases, and is in an amount of more than $5\times10^{-3}$ mol and less than $1\times10^{-1}$ mol with respect to 1 mol of rare earth metal contained in said luminescent substance.

6. The discharge lamp according to claim 5 wherein said promoting substance is one which produces a halogen gas upon initial lighting of the discharge lamp.

7. An electrodeless metal vapor discharge lamp, comprising an airtight arc tube formed with a light transmitting material of a metal oxide, a luminescent substance filled in said arc tube and containing at least one or more rare earth metallic halide, and a promoting substance filled in the arc tube for rendering a halogen cycle occurring adjacent to inner wall surface of the arc tube to be easily promoted, wherein said luminescent substance further contains at least one selected from the group consisting of simple substances of sodium and lithium and respective halides of sodium and lithium which are effective as a red-color emission substance and to lower the color temperature, and said promoting substance contains a metallic halide of a vapor pressure at 100° C. of more than 1 Torr and less than 1,000 Torr for use as a red-color emission substance, with an additional amount of said metallic halide added to be, when the composition of said metallic halide is represented by MXn (M: a metal, X: halide, n: number of halogen), more than $1\times10^{-3}/(n/2)$ mol with respect to 1 mol of said at least one of sodium, lithium and their halides contained in said red-color emission substance.

8. The discharge lamp according to claim 7 wherein said metallic halide promoting substance is in an amount of more than $1\times10^{-3}/(n/2)$ mol and less than $1\times10^{-1}/(n/2)$ mol with respect to 1 mol of said at least one of sodium, lithium and their halides contained in said red-color emission substance.

9. The discharge lamp according to claim 7 wherein said additional amount of said metallic halide promoting substance is antimony iodide.

10. The discharge lamp according to claim 7 wherein said additional amount of said metallic halide promoting substance is indium iodide.

* * * * *